US006805317B1

(12) United States Patent
Andersson et al.

(10) Patent No.: US 6,805,317 B1
(45) Date of Patent: Oct. 19, 2004

(54) ADHESIVE DISPENSER IN A REEL-UP IN A PAPER MACHINE

(75) Inventors: Tommy Göran Andersson, Karlstad (SE); Tomas Eklund, Karlstad (SE); Johan Rågård, Karlstad (SE); Hans G. Johansson, Forshaga (SE)

(73) Assignee: Valmet-Karlstad AB, Karlstad (SE)

( * ) Notice: Subject to any disclaimer, the term of this patent is extended or adjusted under 35 U.S.C. 154(b) by 229 days.

(21) Appl. No.: 09/723,905

(22) Filed: Nov. 28, 2000

(51) Int. Cl.[7] ..... B65H 19/28
(52) U.S. Cl. ..... 242/532.3; 156/578
(58) Field of Search ..... 242/521, 532.2, 242/580, 583; 156/578, 430, 431, 510, 523, 524, 172, 174, 250, 270

(56) References Cited

U.S. PATENT DOCUMENTS

| | | | | |
|---|---|---|---|---|
| 2,845,231 A | * | 7/1958 | Grettve | 242/527 |
| 3,348,520 A | * | 10/1967 | Lockwood | 118/667 |
| 3,951,890 A | | 4/1976 | Reilly et al. | |
| 4,338,147 A | * | 7/1982 | Backstrom et al. | 156/187 |
| 4,422,588 A | * | 12/1983 | Nowisch | 242/524.1 |
| 4,488,687 A | | 12/1984 | Andreasson | |
| 4,572,451 A | | 2/1986 | Ikeda et al. | |
| 4,601,441 A | * | 7/1986 | Oinonen et al. | 242/527.3 |
| 4,711,405 A | | 12/1987 | Niskanen | |
| 5,009,736 A | | 4/1991 | Lehto | |
| 5,048,454 A | | 9/1991 | Berntsson | |
| 5,092,533 A | | 3/1992 | Gangemi | |
| 5,213,649 A | | 5/1993 | Sepavich et al. | |
| 5,614,059 A | | 3/1997 | Boriani et al. | |

(List continued on next page.)

FOREIGN PATENT DOCUMENTS

| | | |
|---|---|---|
| DE | 40 03 577 | 4/1991 |
| DE | 198 14 491 | 10/1999 |
| EP | 0 765 832 | 4/1997 |
| EP | 0 931 744 A3 | 8/1999 |
| WO | WO 95/15901 | 6/1995 |
| WO | WO 97/48632 | 12/1997 |
| WO | WO 98/46510 | 10/1998 |

OTHER PUBLICATIONS

Copy of International Search Report for PCT/SE01/02425 completed Feb. 27, 2002.

Copy of Material Safety Data Sheet for Swift Adhesives—Product Code C965/103, Sep. 1998.

Copy of Material Safety Data Sheet for H.B. Fuller Company—Product No. WB4985 MG, Sep. 1998.

Pamphlet for Core Pick–Up Applications, ITW Dynatec Adhesive Application Solutions, Sep. 21, 2000.*

Pamphlet for Dynamelt ® S Series, ITW Dynatec Adhesive Application Solutions, Sep. 21, 2000.*

Pamphlet for Med Plus ™ BF, ITW Dynatec, Sep. 21, 2000.*

*Primary Examiner*—Donald P. Walsh
*Assistant Examiner*—Joseph Rodriguez

(57) ABSTRACT

A device is provided for winding paper in which the paper web running is supported by a reel drum and wound onto exchangeable reel shafts in contact with the reel drum in order to form rolls of paper. The device applies a heated adhesive agent on the web and/or on the reel shaft onto which the web is to be wound. A spray rack is mounted on the stand of the reel-up, upstream of the reel drum and extending transversely to the machine direction, or alternatively, is mounted in various other locations of the Preinknoll reel-up. A hopper with a heater heats the heated adhesive agent to temporarily lower its viscosity and stickiness for smooth and even spraying. A series of nozzles are mounted on the rack spaced across the width of the web to spread spray jets of liquid containing said heated adhesive onto the web and/or the reel shaft. The adhesive area thus is disposed between the web and the empty reel shaft so as to facilitate initiating the winding process.

32 Claims, 12 Drawing Sheets

U.S. PATENT DOCUMENTS 5,679,408 A 10/1997 Eronen
5,730,387 A 3/1998 Yamazaki
5,816,528 A 10/1998 Ekström et al.
5,845,866 A 12/1998 Kaipf
5,845,868 A 12/1998 Klerelid et al.
5,901,918 A 5/1999 Klerelid et al.
6,045,085 A 4/2000 Andersson et al.
6,086,010 A 7/2000 Kayser
6,131,770 A * 10/2000 Allen ..... 222/55
6,135,000 A 10/2000 Caspar et al.
6,142,207 A 11/2000 Richardot
6,238,484 B1 * 5/2001 Hasegawa ..... 118/302
6,253,818 B1 7/2001

* cited by examiner

ADHESIVE DISPENSER IN A REEL-UP IN A PAPER MACHINE

FIELD OF THE INVENTION

The present invention relates to papermaking machines, and more particularly relates to a device for winding a web onto a shaft and for applying an adhesive between the web and the shaft to facilitate starting the winding process.

BACKGROUND OF THE INVENTION

Production speed of tissue web is of paramount importance. Production speeds for tissue webs have leveled off in recent years. This is thought to be a result of the increasing demand for high-quality tissue and the technical difficulty of maintaining higher production speeds. At higher production speeds the tissue webs tend to vibrate and rupture due to their low basis weight and tensile strength.

Reel changing comprises switching a completed paper roll with a new, empty reel and initiating tissue web winding on the new reel. Efficient reel changing increases overall production speed by minimizing the length of downtime between reels and the number of failed reeling attempts.

A common way to initiate tissue web winding on a new reel is by threading. Threading means that a web end is pulled along through a paper or board machine by a leader. The leader consists of a strip of web which may initially be only 40 to 50 cm wide, but gradually becomes wider until it extends across the entire width of the web. The leader is cut out in the continuous web, starting either at one edge or somewhere at an optional distance from either edge of the web, whereas its length is determined by the time it takes for the tip to extend across the entire width of the web. Due to the high web speed the leader may be very long, 180 to 200 m. This incurs considerable costs for the paper mill since the cut part of the paper web must be discarded for each paper reel.

Sanitary tissue products, usually manufactured of tissue paper, are extremely market-sensitive and the quality of the product is therefore often more important than its quantity. It is thus important that during reeling the paper reel acquires several important properties, e.g., homogeneity and lack of wrinkles, tears or folds. Furthermore, high efficiency in the following conversion machines can only be achieved if the reels of paper from the paper machine have a homogenous high quality.

Soft paper with low strength must be reeled carefully in order to keep the paper qualities such as density and elasticity as constant as possible throughout the reel. The two main factors affecting reel density are web tension and radial pressure at the nip of the reel-up. Lower nip pressure is important to obtain lower average density.

The thickness and elasticity of the web decreases from the outside of the reel to the center in a radial direction. This is because the compressive stress is built up in the paper reel during reeling and compresses the inner radial parts of the reel. This causes a decrease in thickness of the inner web layers. This effect increases if the reel is stored for too long before being rewound or converted.

Reeling problems arise when a new reel of paper is commenced with the aid of the tapered leader as mentioned above, since the web turns applied during winding of the innermost layers produce an uneven radial growth axially along the reel shaft so that the reel becomes carrot shaped. This is caused partly by the superelevation of the web and partly by differences in the nip pressure across the web.

If the cross-sectional profile of the paper web differs with regard to thickness, web tension or elasticity then pleating, crushing damage, defects in web and axial forces in the reel will occur at a high nip pressure. This may, in worst cases, result in web rupture. Eliminating the incidence of the carrot shaped reel, high nip pressure and web rupture could be accomplished with an apparatus for full-width reel changing. Changing "full-width" reels in the present context refers to wrapping the entire width of the web around the reel shaft when initiating a new reeling operation. This is to be distinguished from threading using a tapered leader.

High web speed machines use either the threaded or full-width methods and must wrap the web around the empty reel shaft. At high web speeds, glue is applied to the leader itself before it is threaded. At low speeds, such as those used for tissue paper production, full-width methods assisted by balloon blowing are common. Balloon blowing entails creating slack across the full width of the web by somewhat retarding the finished reel. With the aid of compressed air, the fold thus formed is then forced into the nip between the new reel shaft and the reel drum, after which the web is cut off. In order to increase the reliability of this type of reel switching, glue or tape is also applied, but only on the actual reel shaft before this comes into contact with the paper web.

Many methods of glue or adhesive application have been used such as manual application using a large brush or spray gun. Regardless of the transfer method used for switching reels, it is important that the glue is still adhesive when contact occurs between the paper web and reel shaft. It is thus desirable to use simultaneous glue spraying as opposed to manual methods.

Automatic glue spraying is accomplished with the aid of glue nozzles, generally placed at one side of the paper web, close to the primary arms. However, when applying the glue by means of spraying, great care must be taken to avoid the glue being misdirected. In earlier attempts at full-width reel switching considerable problems have been encountered with the use of spray pipes across the machine direction. The glue from spray pipes tends to drip onto the paper web below, causing the web layers to adhere to each other and the web to be torn during rewinding.

The use of aerosol jets for glue application avoids some of the problems of dripping as is demonstrated by U.S. Pat. No. 6,045,085. This invention mixes compressed air of predetermined amounts with the conventional liquid glue or adhesive as it exits a nozzle. The nozzle is actually one nozzle inside another, one of which sprays the compressed air and the other the liquid glue. The glue is distributed in a flat and wide fish tail pattern by several of the nozzles arranged side-by-side on a screen mounted upstream of the paper reel. The consistency of the aerosol spray avoids some of the dripping problems encountered with the spray pipes. However, glue and dust still have a tendency to collect on the tips of the nozzles, which sometimes results in dripping.

European Patent Application EP 0 931 744 A2 discloses a reel-changing method that involves spraying glue directly onto the sleeve of the core. However, the conventional glues used in both of the documents can clog the gluing apparatus because they tend to harden when they dry, and then require dissolving with a suitable solvent in order to free the clogs. The invention taught by U.S. Pat. No. 6,045,085 uses a needle apparatus to address the problems of glue clogging at the nozzles, but the needle doesn't always clear the nozzles efficiently and the nozzles may still become plugged with glue. Also, the glue must be continuously circulated in the conduits supplying the nozzles to reduce the incidence of clogging. This increases the weight of the equipment that must be supported by a spray rack or screen. The viscosity of the glue can be decreased by dilution, but then the glue loses much of its stickiness.

Therefore, it would be advantageous to automatically apply an adhesive between the web and the reel shaft on which it is wound for full-width reel switching, such that the adhesive can be applied evenly, in a very controlled area and without problems of dripping or clogging. Also, it is important that the glue remain sticky after application, while being flowable so that it can be easily applied.

SUMMARY OF THE INVENTION

The apparatus and method according to the invention meets these and other needs and is characterized by a rotatable reel drum supporting a web wrapped partially about the reel drum. The apparatus includes a winding device for supporting and rotating the reel shaft about its axis. At least one of the reel drum and the winding device for supporting the reel shaft is movable toward the other to place the rotating reel shaft in a winding position proximate the reel drum such that the web on the surface of the reel drum is engaged by the rotating reel shaft. A plurality of spray nozzles are operable to spray an adhesive and are located to spray the adhesive on either the web, or the outer surface of the reel shaft, or both. The plurality of spray nozzles can be located in various mounting positions such as near the web upstream of the reel drum, at the nip between the reel shaft and reel drum, or directly onto the reel shaft. The spray nozzles can also be located to spray on the reel shaft as it is lowered from a stock of empty reel shafts by a lowering arm into the position proximate the reel drum, by fixing the nozzles to the frame of the winding device, or to the lowering arms in a reel-up having such arms.

Application of the adhesive on the web and/or reel shaft allows the web to adhere to, and begin winding about, the reel shaft as it is brought into engagement with the web on the reel drum. An adhesive supply apparatus includes a tank, at least one conduit and a driving unit. The driving unit includes a piston, a pump, compressed air or other means for delivery of the adhesive from the tank to the nozzle and to spray the adhesive out. In accordance with the invention, the adhesive is characterized by a viscosity that becomes lower upon the heating of the adhesive. Thus, no dilution of the adhesive is needed in order to render it flowable. Instead, the adhesive is heated to a temperature sufficient to reduce the adhesive viscosity to a level at which the adhesive can be readily sprayed from the nozzles. The tank thus preferably comprises a heater and holds the adhesive, which is heated by the heater to render the adhesive flowable. The adhesive could be solid or liquid, but is preferably a semi-solid, or is gel-like and is also water soluble. The conduit connects the tank with the spray nozzles and the driving unit delivers the flowable adhesive through the conduit to the spray nozzles. The adhesive is preferably heated all the way to the nozzles only enough to reduce the viscosity sufficiently to allow the adhesive to be delivered more easily through the conduits to the nozzles. Even if the adhesive solidifies upon cooling, such as during a shut-down of the winding apparatus, clogs can be easily cleared by heating the adhesive in the system.

BRIEF DESCRIPTION OF THE DRAWINGS

Figure 1:
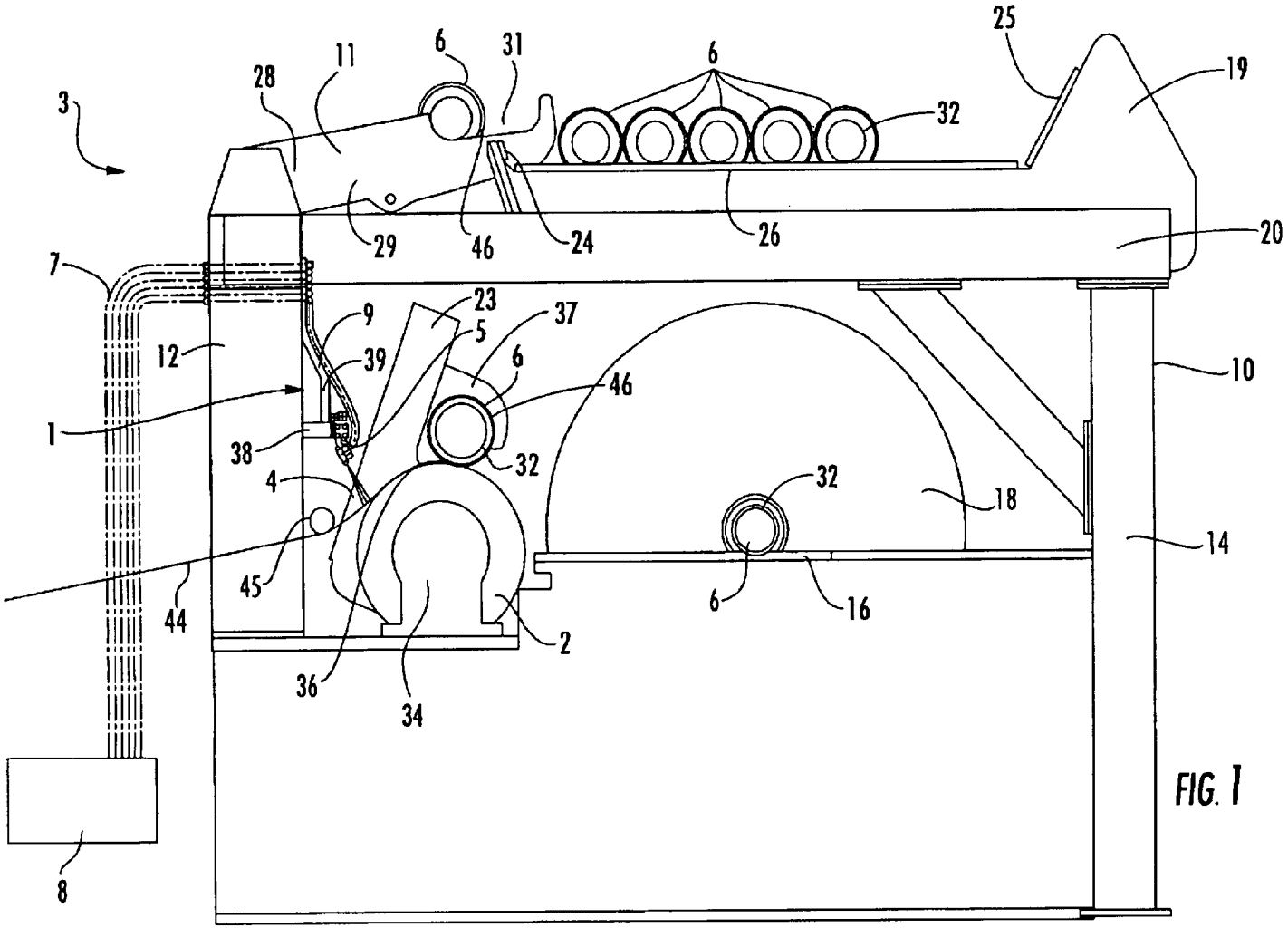

Having thus described the invention in general terms, reference will now be made to the accompanying drawings, which are not necessarily drawn to scale, and wherein:

FIG. 1 is a schematic side view of parts of a reel-up according to the invention seen from one long side showing the heated glue-spreading device with nozzles positioned to spray the web upstream of the nip.

Figure 2:
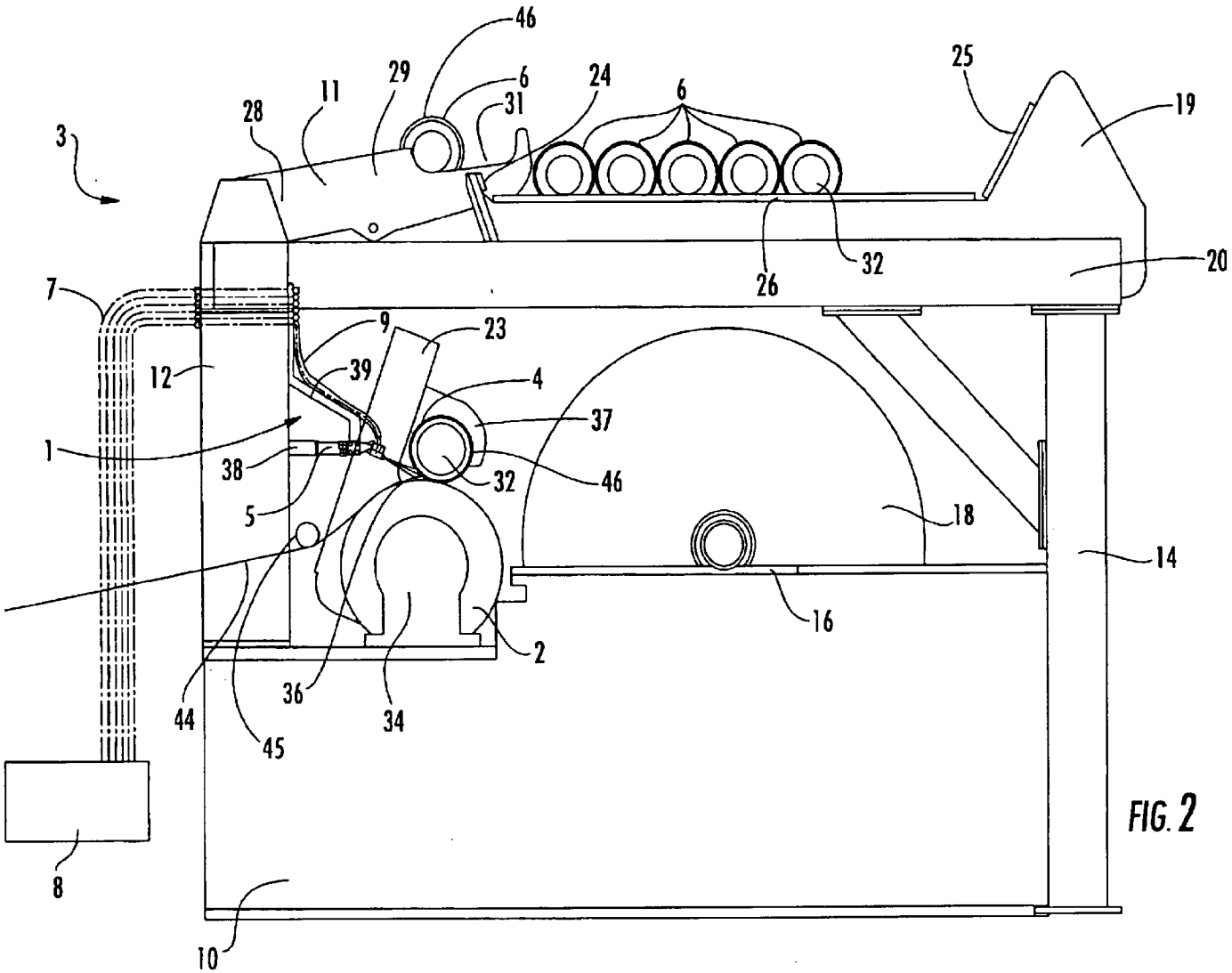

FIG. 2 is a schematic side view of the reel-up showing the heated glue-spreading device with nozzles positioned to spray into the nip.

Figure 3:
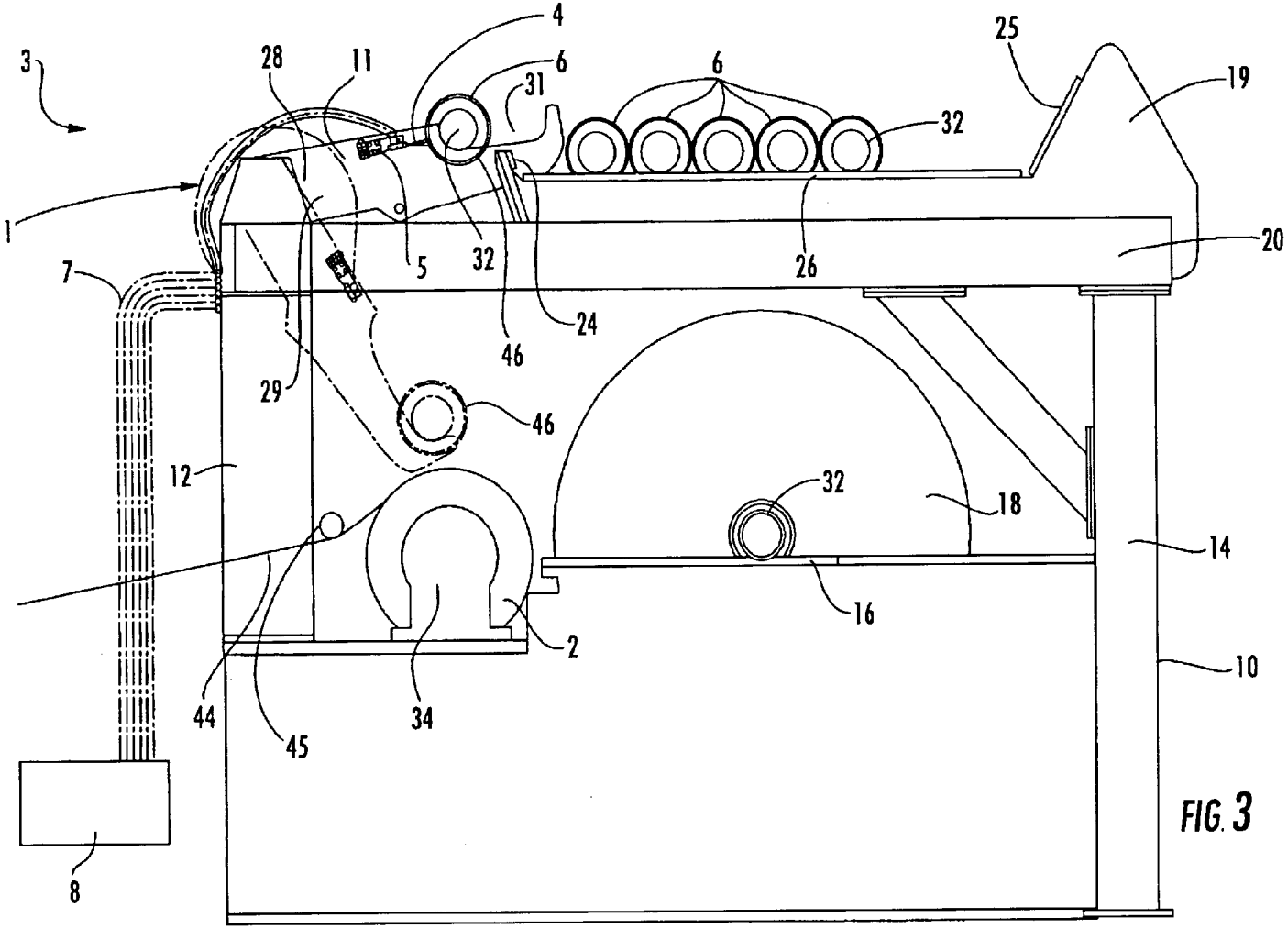

FIG. 3 is a schematic side view of the reel-up showing the heated glue-spreading device with nozzles positioned on the lowering arms for spraying onto a newly acquired reel shaft.

Figure 4:
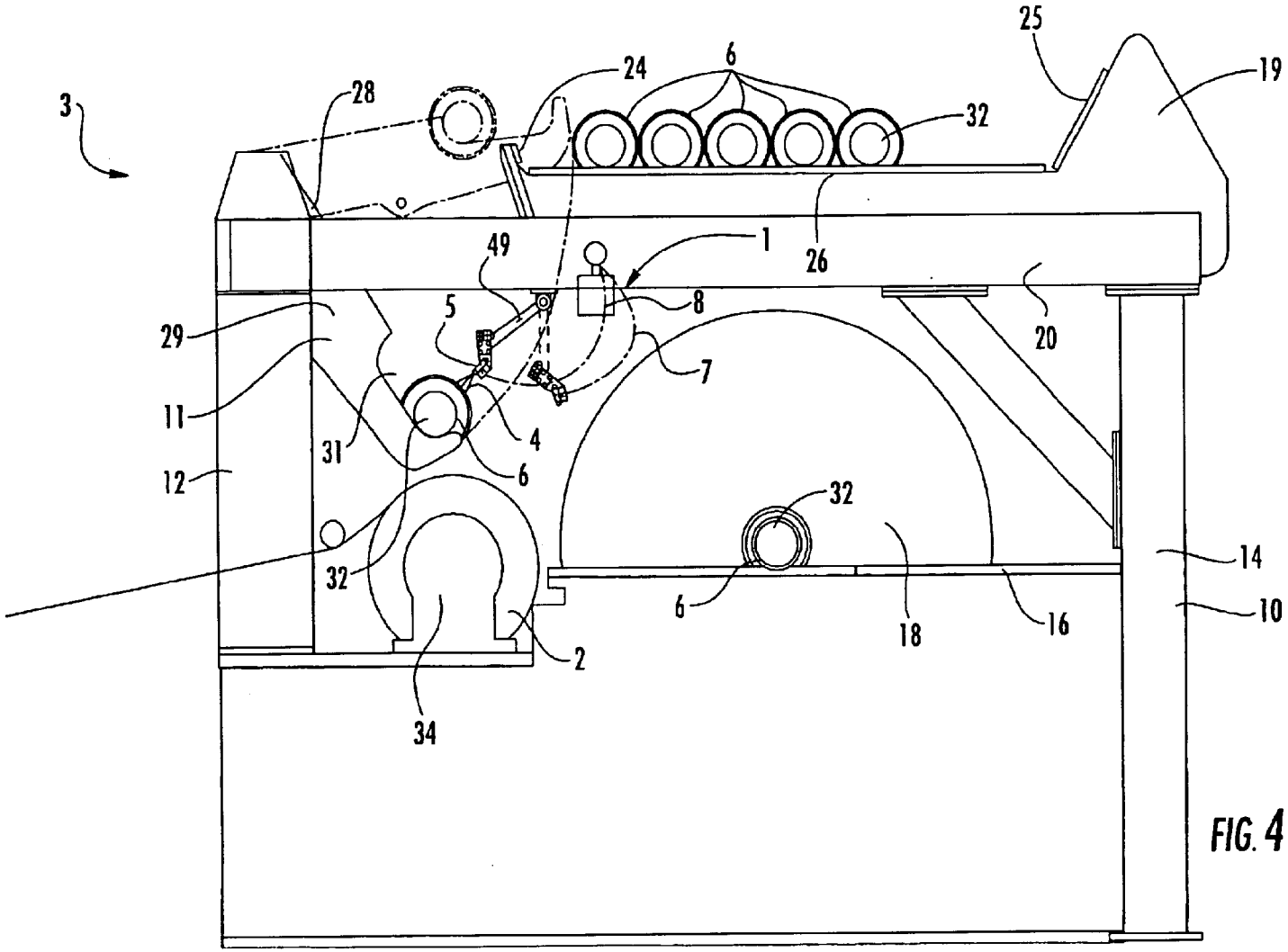

FIG. 4 is a schematic side view of the reel-up showing the heated glue-spreading device with nozzles positioned to swing in and out of range of the reel shaft as it is lowered by the lowering arm.

Figure 5:
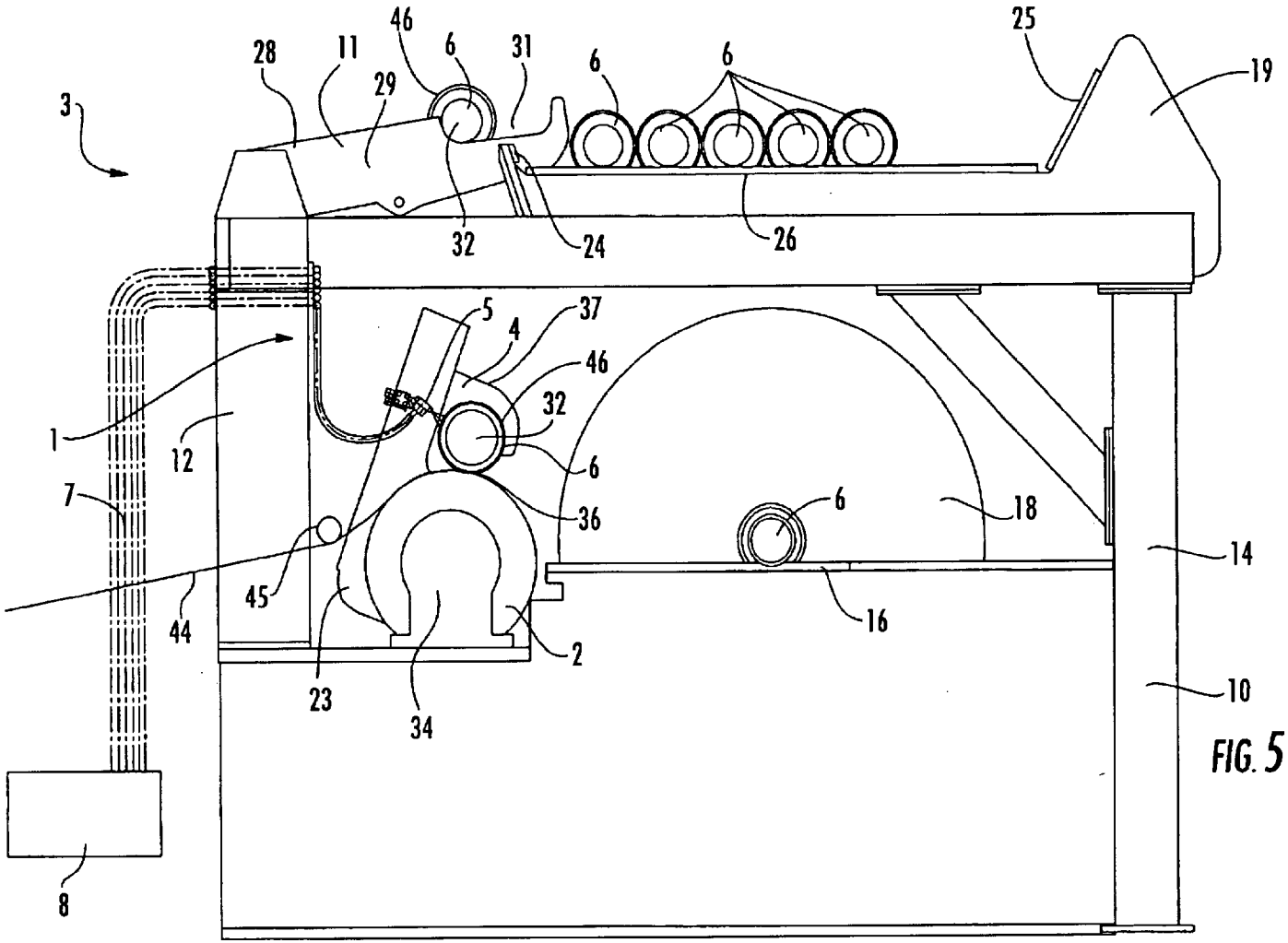

FIG. 5 is a schematic side view of the reel-up showing the heated glue-spreading device with nozzles fixed relative to the primary arms to spray adhesive on the reel shaft.

Figure 6:
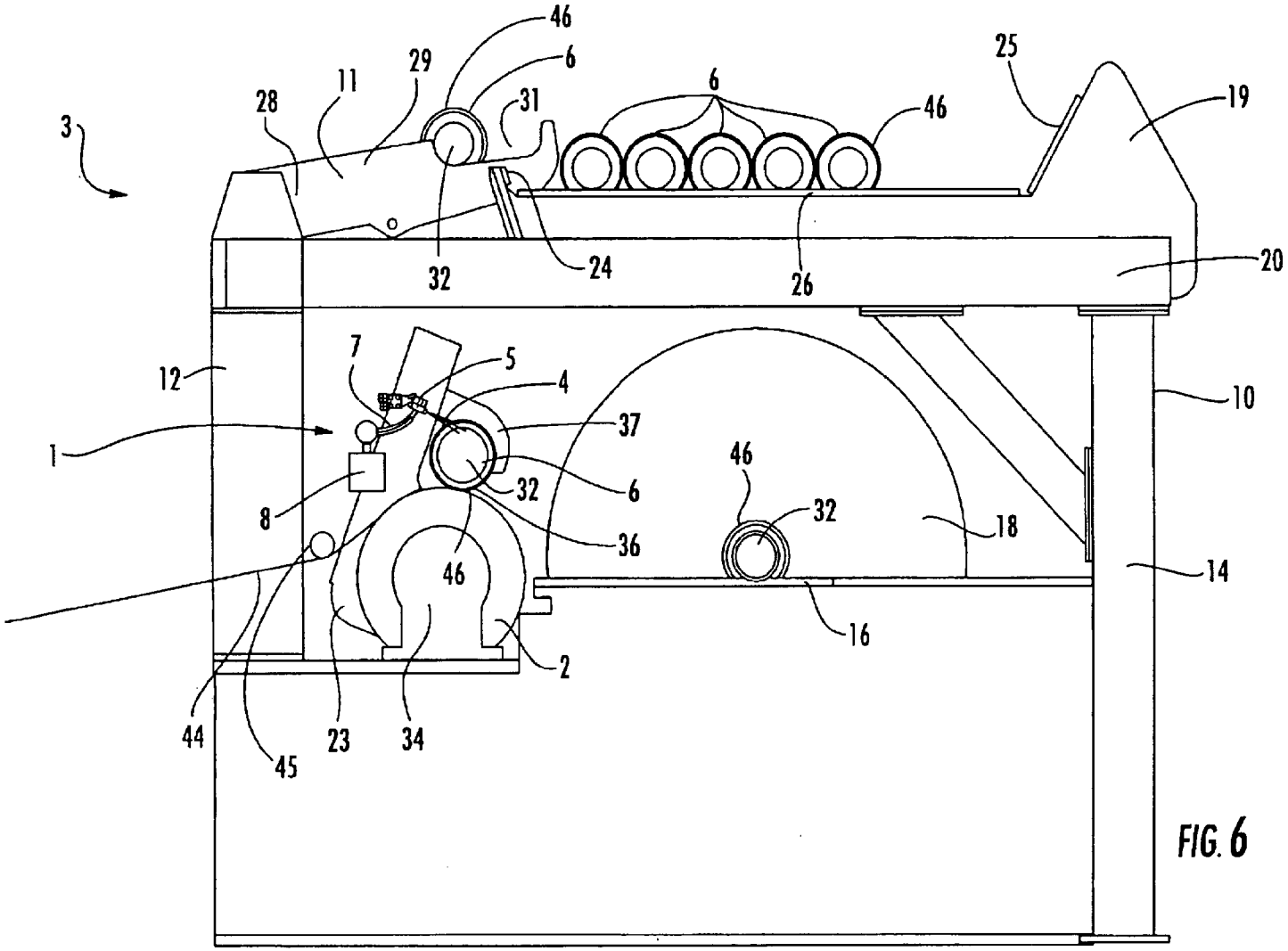

FIG. 6 is a schematic side view of the reel-up showing the heated glue-spreading device with nozzles and the adhesive supply apparatus mounted on the primary arms to spray adhesive on the reel shaft.

Figure 7:
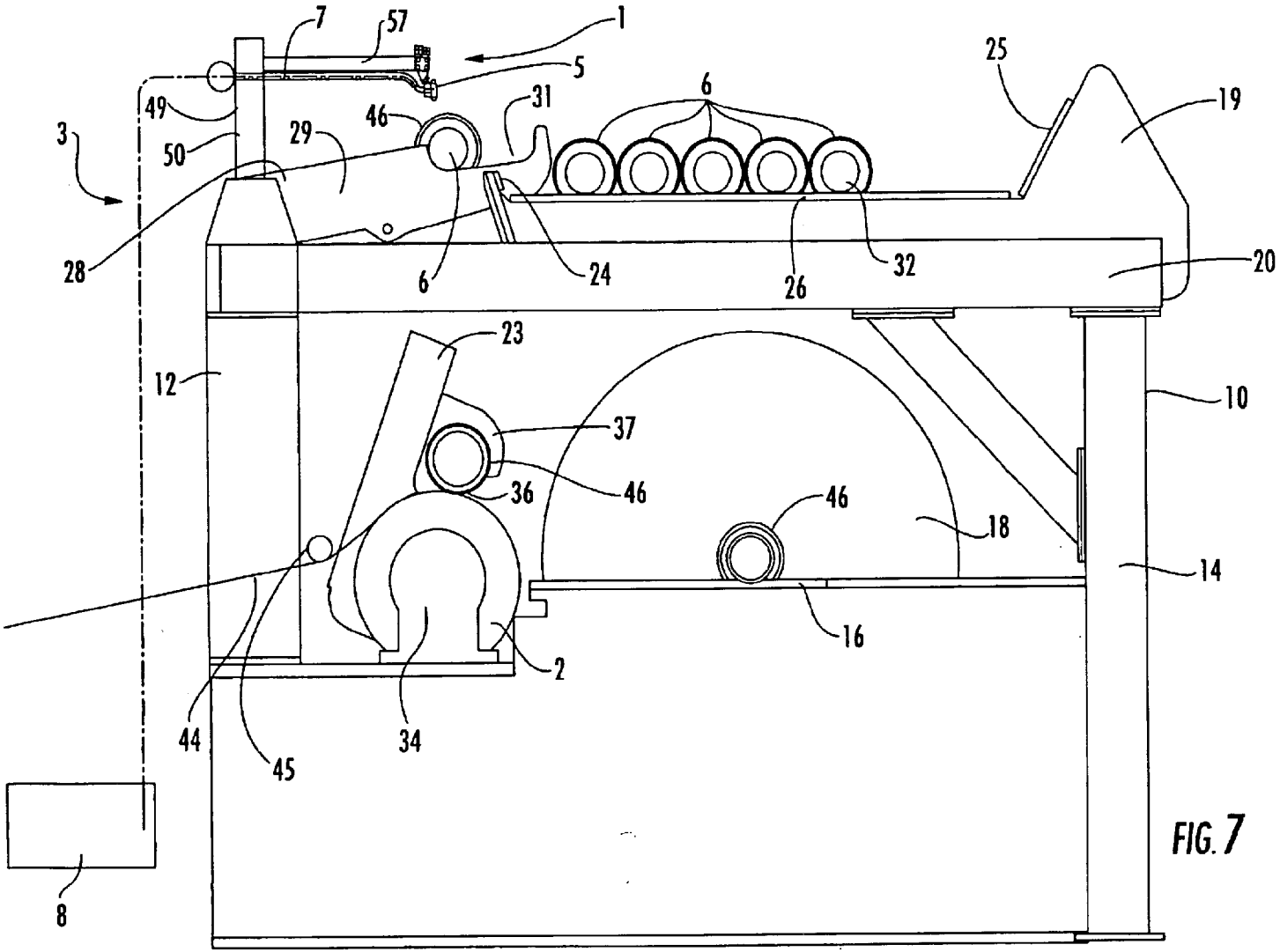

FIG. 7 is a schematic side view of the reel-up showing the heated glue-spreading device with nozzles positioned proximate to the stock of empty reel shafts and at the end of the gantry arm to spray a newly retrieved reel shaft held by the lowering arms.

Figure 8:
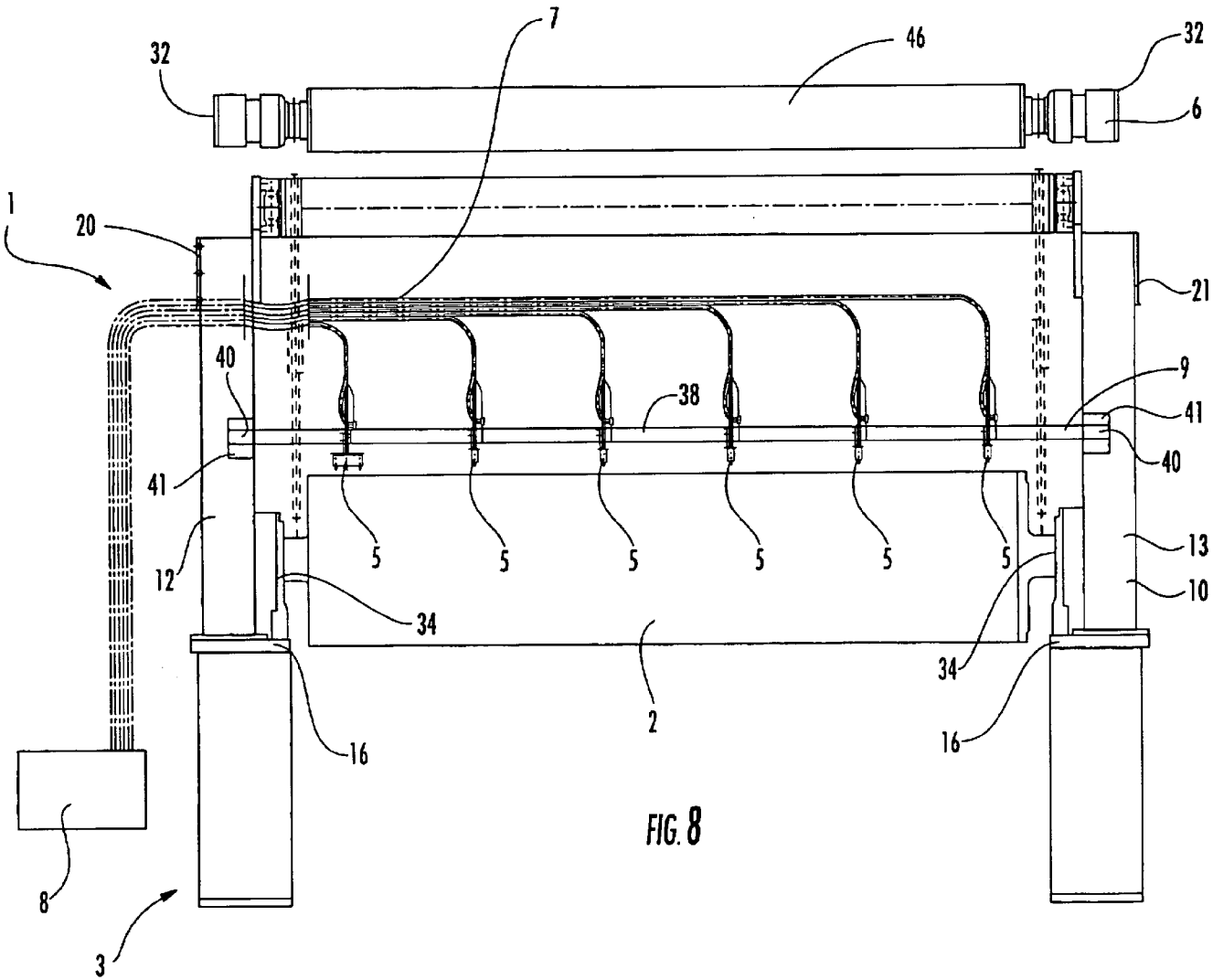

FIG. 8 is a schematic front view of the reel-up showing the arrangement of the nozzles and their respective conduits mounted transversely to the machine direction.

Figure 9:
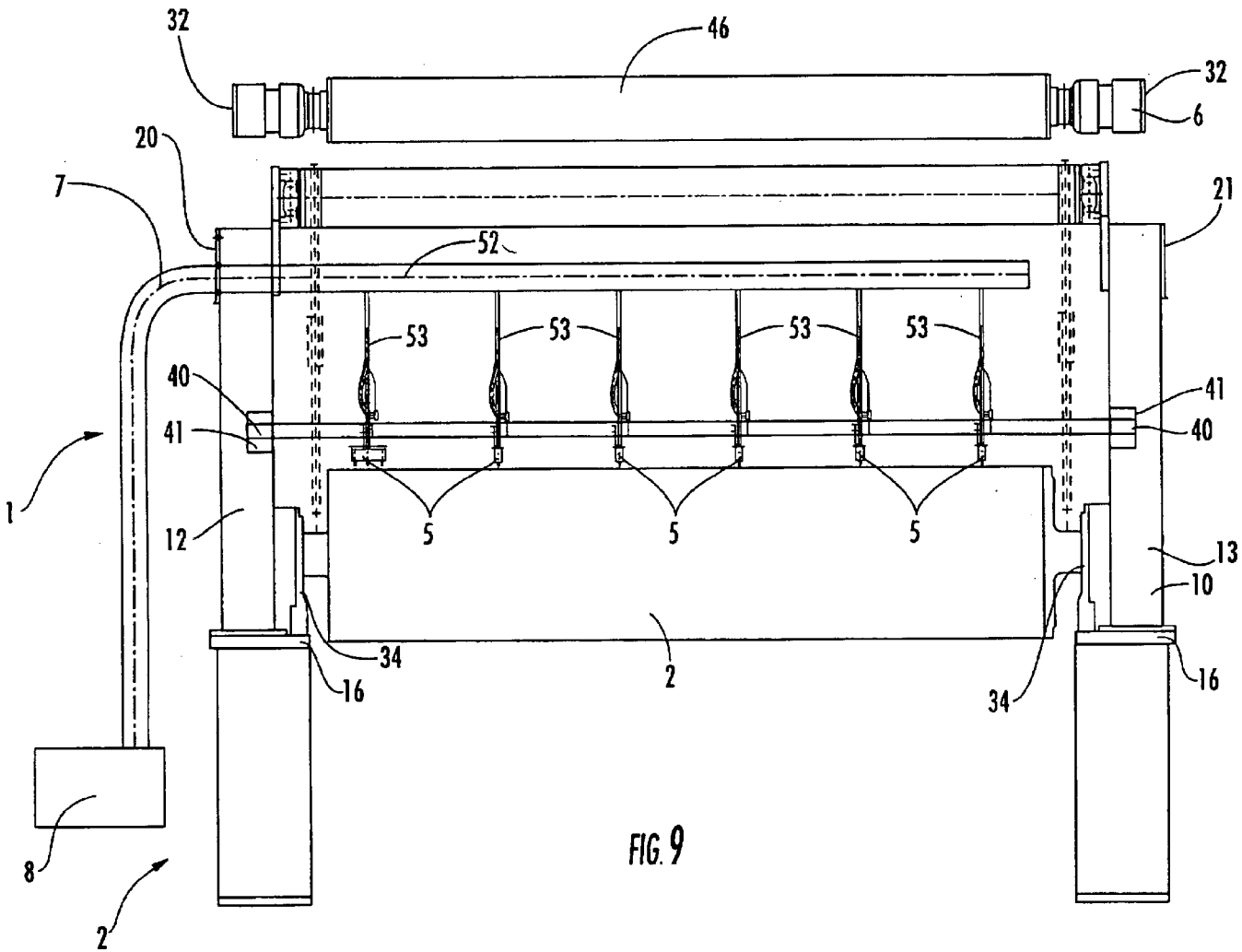

FIG. 9 is a schematic front view of the reel-up showing the arrangement of the nozzles and a main conduit mounted transversely to the machine direction.

Figure 10:
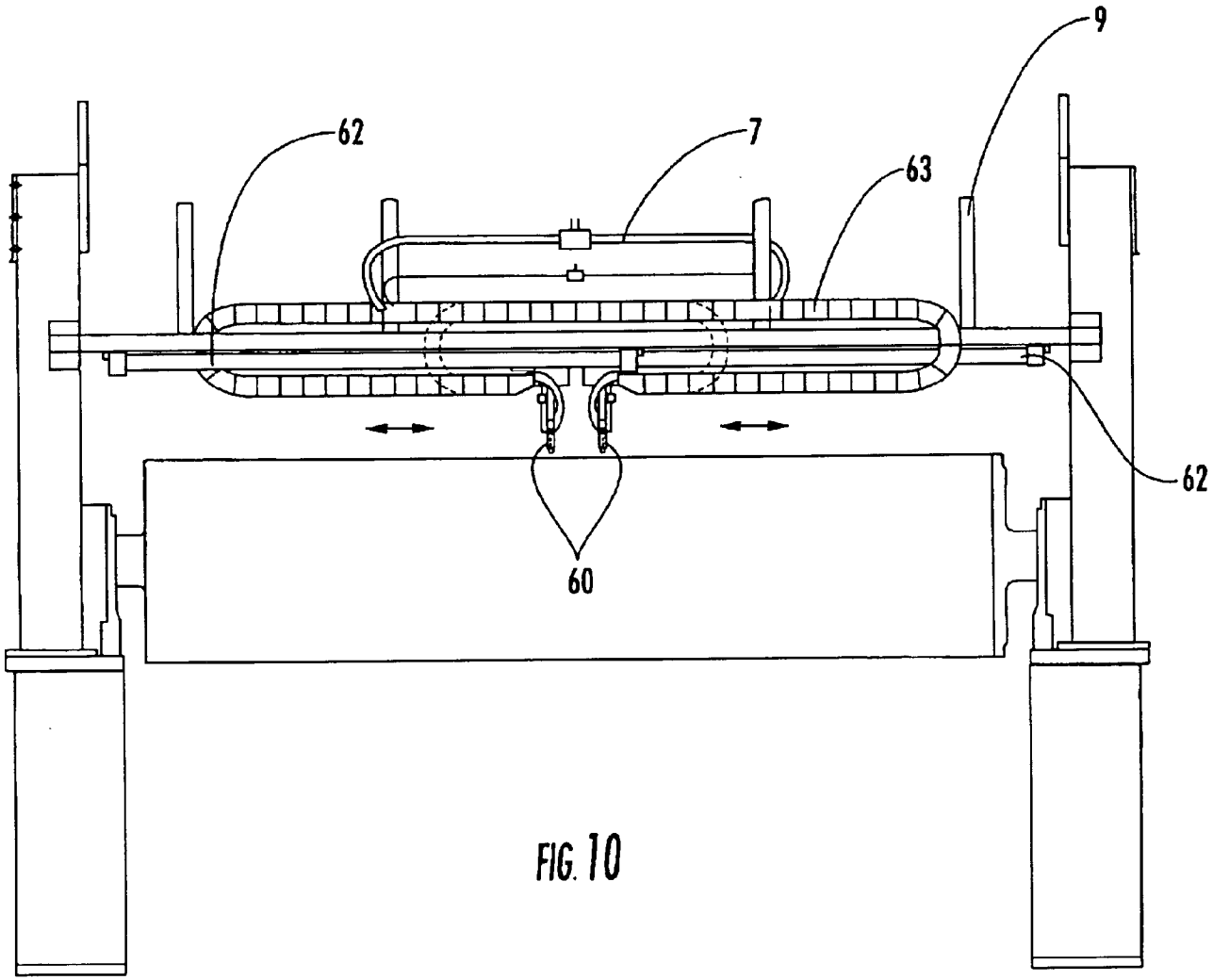

FIG. 10 is a schematic front view of the reel-up showing the arrangement of the pair of translatable nozzles that move transverse to the machine direction.

Figure 11:
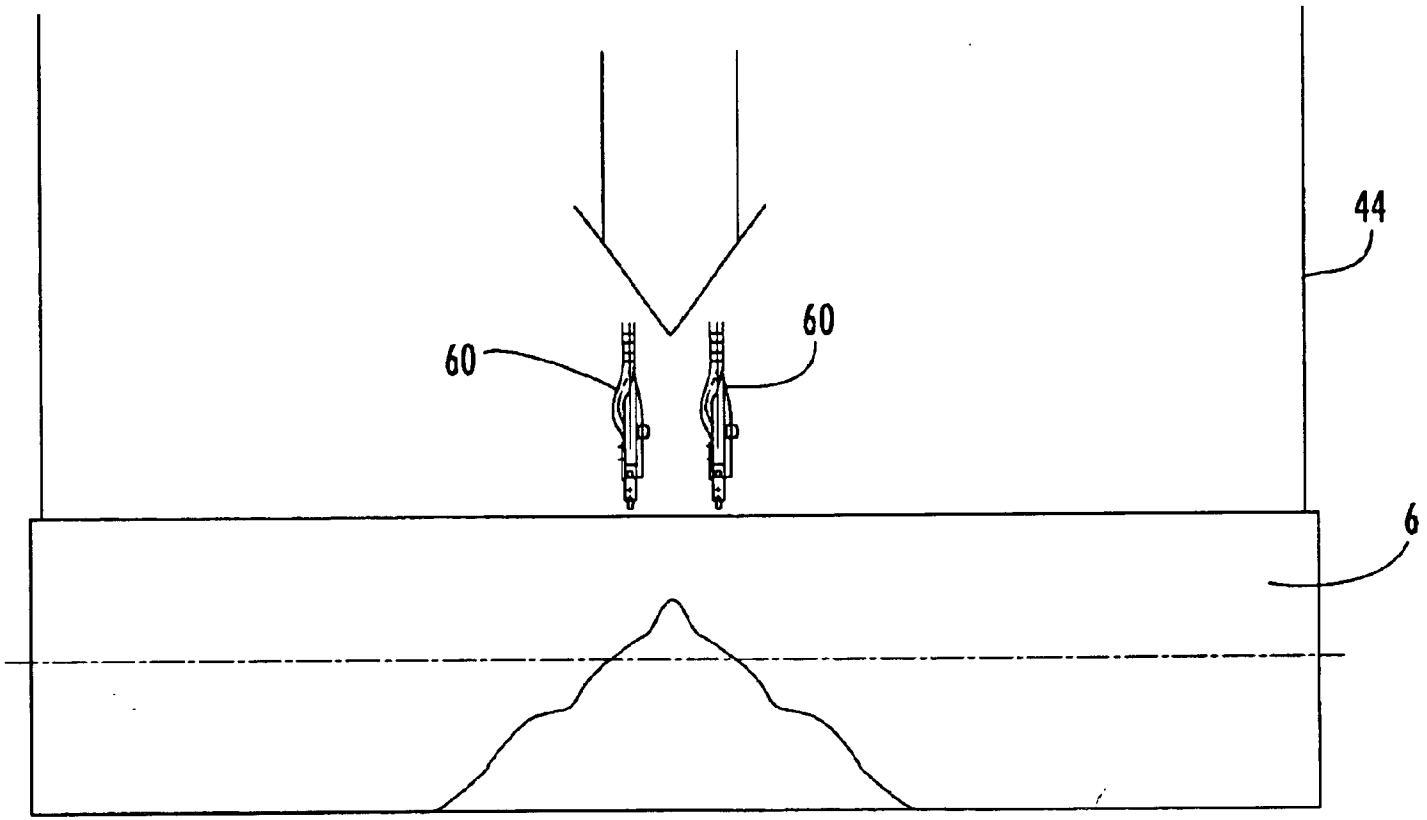

FIG. 11 is a schematic plan view of the line of adhesive application formed by the pair of nozzles shown in FIG. 10 applying an adhesive interface extending diagonally from the center out to the edges in an upstream direction of the web.

Figure 12:
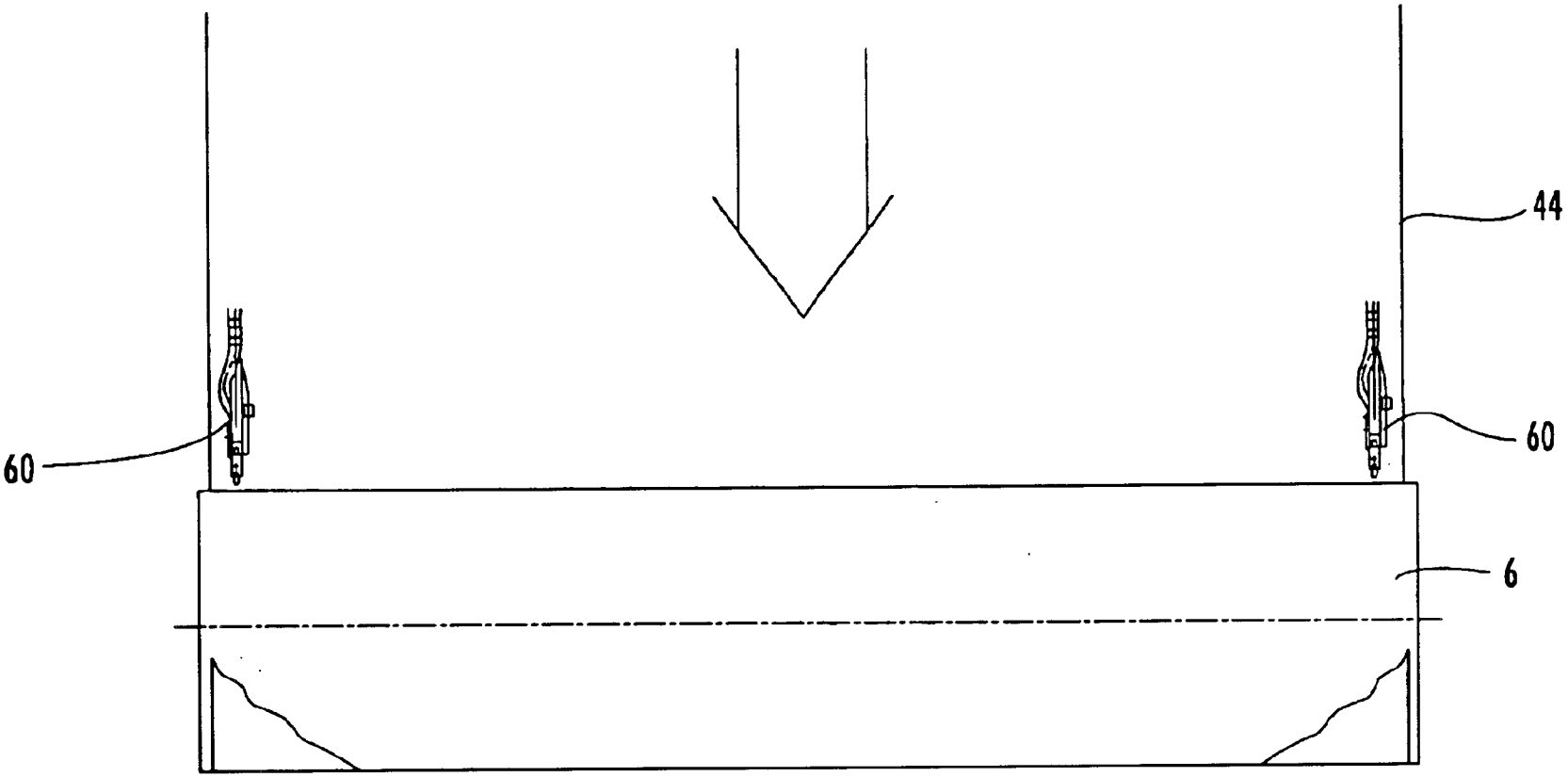

FIG. 12 is a schematic plan view of the line of adhesive application formed by the pair of nozzles shown in FIG. 10 applying an adhesive interface extending from the edges toward the center in an upstream direction of the web.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 and 8 show schematically a preferred embodiment of a heated glue-spreading device 1 arranged upstream of a supporting device such as a reel drum 2 in a reel-up 3 of a paper machine. The reel drum 2 supports the paper web during winding. A winding belt could be used in place of the reel drum 2 for supporting the paper web. When performing full-width reel switching it is possible according to the invention to apply a heated adhesive across the paper web so that the whole width of the paper web is covered by jets 4 from nozzles 5 mounted in the heated glue-spreading device 1, thereby attaching a web end either to a new reel shaft 6 or to an existing paper roll. The heated glue-spreading device 1 comprises a series of nozzles 5 mounted on a rack 9 transverse to the machine direction and connected by conduits 7 to an adhesive heating hopper 8.

The rack 9 is mounted on a stand 10 of the reel-up 3, on which stand 10 a pair of lowering arms 11, the reel drum 2 and a pair of primary arms 23 are also mounted. As shown in FIGS. 1 and 8 the stand 10 comprises a box like frame of four pillars 12, 13, 14, 15, and a pair of top support beams 20, 21 mounted atop the pillars and extending in the machine direction. Pillars 12 and 13 are at an upstream end of the reel-up 3 and pillars 14 and 15 are at the downstream end of the reel-up 3. The reel-up 3 includes a pair of rails 16 for supporting a completed paper roll 18 with opposite ends of its reel shaft 6 resting on the rails 16.

Stand 10 includes a pair of rails 26 for supporting opposite ends of a plurality of empty reel shafts 6, and a pair of front stops 24 and a pair of rear stops 25 at opposite ends of rails 26. The pair of rails 26 are sloped toward the upstream end of the reel-up 3 and hold a stock of empty reel shafts 6. Empty reel shafts 6 include ends 32 that roll on the pair of rails 26. Each reel shaft 6 is preferably either a metal shaft on which the paper is directly wound, a metal shaft having a paper core tube sleeved over it, or a paper or polymer tube with no metal shaft. The slope of rails 26 urges the empty reel shafts 6 to roll along rails 26 toward the front stops 24 and away from rear stops 25.

Lowering arms 11 comprise plate structures each including a base end 28, a mid portion 29 and a hook portion 31, and are connected to hydraulic cylinders of a hydraulic system (not shown). The base ends 28 are pivotally mounted to stand 10 adjacent the front pillars 12 and 13.

A reel drum 2 is rotatably journalled to a pair of stand members 34 fixed relative to and disposed adjacent to the rails 16. Over the surface of reel drum 2 runs the continuous web 44 coming from a production stage of a papermaking machine. The reel drum 2 can be directly driven by a drive motor (not shown) operably coupled to the reel drum 2. The reel drum 2 can have either a solid or flexible surface.

The use of a reel drum 2 in the preferred embodiment is not meant to be limiting, as support for the web 44 could be provided by other types of supporting devices. For instance, the reel drum 2 could be replaced by a moving belt on which the web 44 can be supported and fed onto the reel shaft 6. Another alternative is to use a foil as a web supporting device. In one embodiment, the foil has a downstream edge that forms a nip with the reel shaft 6 through which the paper web is guided onto the paper roll. In other embodiments, the foil does not form a nip with the paper roll, in which case there can be a very short free draw between the downstream edge of the foil and the paper roll.

Primary arms 23 support the reel shaft 6 through at least an initial part of the winding process. Primary arms 23 comprise a reel shaft gripper 37 operable to hold reel shaft 6 against reel drum 2 to form a nip 36. The reel shaft gripper 37 is driven by an actuator (not shown) comprising a pneumatic or hydraulic cylinder. The actuator adjusts the radial position of reel shaft gripper 37 to allow for increasing diameter of reel shaft 6 during wind-up.

Primary arms 23 also comprise a pivot unit (not shown) journalled in stand 10 allowing primary arms 23 to cooperate with the reel shaft 6. The primary arms 23 are rotated about the axis of the pivot unit by an actuator (not shown) comprising a pneumatic or hydraulic piston cylinder. Rotation of the primary arms 23 about the pivot unit allows the reel shaft 6 to be moved along the surface of the reel drum 2 during wind up so that the building reel can be delivered into a secondary unit (not shown) which then takes over the winding process. Primary arms 23 and secondary units are common in the art of papermaking machines, and thus are not described in any detail herein. The secondary unit completes the winding onto reel shaft 6 to form a completed paper roll 18, after which the reel 18 is transferred along the pair of rails 16 to a further station.

The rack 9 includes a horizontal mounting bar 38 that extends in a cross-machine direction between pillars 12 and 13, and a series of generally vertical tube supports 39 affixed to the mounting bar 38. Mounting bar 38 is affixed at its ends 40 through two fixation plates 41 to the inside face of front pillars 12 and 13. Fixation plates 41 can be fixed on the pillars via fasteners or by welding. Tube supports 39 are elongate members that have upper ends affixed to a member (not shown) that extend between front pillars 12 and 13 and extend downward to attach at their lower ends to mounting bar 38.

A more specific description of the heated glue-spreading device 1 will reveal its advantages over conventional reel changing systems. The glue employed in the present invention has some unique characteristics that distinguish it from other types of glues or adhesives. The glue at room temperature can be solid or semi-solid (e.g., gel-like), but when heated its viscosity becomes much lower so that it can be sprayed from the nozzles 5. These characteristics are advantageous for several reasons. Nozzles 5 and conduits 7 are less likely to clog or suffer from build up and contamination because heating of any residual glue in the system renders the glue flowable. The invention thus reduces down time for maintenance. Once the glue application is completed and the heating of the glue discontinued, the glue returns to its solid or semi-solid state, and hence is less likely to drip or run compared with conventional liquid adhesives. This minimizes dripping of glue onto the web which could result in sequential turns of web in a completed roll being stuck to each other, leading to a waste of paper.

Nozzles 5, conduits 7 and adhesive heating hopper 8 advantageously can comprise a Dynatec heated adhesive application system available from ITW Dynatec of Hendersonville, Tenn. As shown in FIG. 8, six individual nozzles 5 are each attached to an individual conduit 7 of heated, flexible hose or pipe which carries a glue supply. Adhesive heating hopper 8 includes a heated hopper grid for heating the adhesive to make the adhesive flowable. A driving device is connected to, or incorporated in, the hopper 8 for dispensing the adhesive or a source of pressurized air to the conduits 7. The driving device can be an internal piston pump in the hopper for pumping the flowable adhesive, or can be a source of pressurized air coupled with the hopper.

As shown in FIG. 8, six nozzles 5 are mounted on mounting bar 38 at equal intervals in the cross-machine direction. Conduits 7 extend from the hopper 8 upwards to wrap around the top of front pillar 12 and then extend as a group in a cross-machine direction toward pillar 13. Each conduit 7 separates from the group and drops downward and along each tube support 39 to connect to a respective nozzle 5. Thus, the tube supports 39 provide support for the individual conduits 7 which are preferably constructed of heated and flexible hose which maintains the adhesive at a predetermined temperature. Alternatively, it would be possible to construct conduits 7 from rigid piping which would not require support members.

During web reeling, a continuous web 44 travels over a guide roll 45 and into the nip 36 formed between reel shaft 6 and reel drum 2. Heated glue-spreading device 1 is positioned in this embodiment on the upstream side of the nip 36 to spray glue on web 44 just before it enters nip 36. Nozzles 5 are mounted on mounting bar 38 pointing in a downward direction (towards web 44) and at a slight angle in the direction of nip 36.

Empty reel shafts 6 are retrieved from stand 10 by lowering arms 11. Lowering arms 11 rotate upwards, propelled by hydraulics, until hook portion 31 engages the nearest empty reel shaft 6 that has rolled, or been moved, up to front stop 24. Lowering arms 11 lower the empty reel shaft by rotating downwards. Primary arms 23 receive the lowered reel shaft 6 and grip it via reeling shaft grippers 37, and typically engage the reel shaft 6 with a drive device (not shown) to rotate the drum to a peripheral speed matching that of the reel drum 2. The empty reel shaft 6 is then engaged with the reel drum 2.

The heated glue-spreading device 1 is activated by heating the adhesive (e.g., Swift Adhesives C968/103) in the adhesive heating hopper 8 to about 75° C., or to a temperature sufficient to reduce the viscosity of the adhesive to a point enabling the adhesive to be pumped to the nozzles 5. The temperature of the adhesive is maintained while the adhesive is pumped to nozzles 5 via the heated conduits, hoses or pipes 7.

Jets 4 of heated adhesive are emitted from nozzles 5. The jets 4 are activated simultaneously and for a predetermined period of time. If desired, the jets 4 could also be activated by opening nozzles 5 individually, in any order, and for varying periods of time. Jets 4 spray onto web 44 at a location between guide roll 45 and the nip 36. Jets 4 are preferably dispersed in a flat fan, or fishtail-like, spray that applies adhesive in an even line across the top of web 44 and transverse to the machine direction. After the heated glue exits nozzles 5, it immediately begins to cool, gaining viscosity and stickiness. Once the glue reaches room temperature, it returns to its original (e.g., semi-solid, or gel like) state that is resistant to runs and drips. Thus, its spray pattern on web 44 is even, consistent and sticky. Spray patterns may be varied depending upon the type of web, the positioning of the nozzles, the size of the reel drum and reel shafts, etc. However, a flat fan has the advantage of minimizing the number of nozzles 5 and the amount of errant glue that hits other parts of the machine.

Web 44 is advanced through nip 36 where the applied glue on the top side of web 44 encounters the outer surface 46 of reel shaft 6. The now cooled and sticky glue sticks to the outer surface 46 of reel shaft 6 and web 44 becomes secured to drum 6. The web 44 is severed in a suitable manner from the tail end that winds onto the previously completed paper roll 18. Web 44 is then wound onto reel shaft 6 to form the next completed paper roll 18.

Different temperatures, pressures and heated glue types can be adapted to the various needs of different web materials. The invention is particularly well suited to the reel-up, or winding, of fragile tissue papers for sanitary uses which are prone to tearing and are market sensitive to folds and other inconsistencies. However, the invention can be used for winding of any grade of paper. A consistent and sticky glue application will minimize tears and folds that can occur from the less uniform application of a cold adhesive. Some advantages can be gained from different positioning of nozzles 5 as will be shown by other embodiments.

FIG. 2 shows a second embodiment of the heated glue-spreading device 1 where nozzles 5 are positioned to spray directly into nip 36. Nozzles 5 are supported by rack 9 similar to the first embodiment, but they are angled toward nip 36. The nozzles 5 are in closer proximity to nip 36 because tube supports 39 extend further in the downstream direction of the reel-up 3. The direction of jets 4 into nip 36 is advantageous in that it dispenses heated glue onto both the top of web 44 and on the outer surface 46 of reel shaft 6 which can provide a more secure binding between web 44 and outer surface 46.

FIG. 3 shows a third embodiment where heated glue-spreading device 1 dispenses glue onto reel shaft 6 while it is held in lowering arms 11. In this embodiment, nozzles 5 are fixed relative to lowering arms 11. This allows nozzles 5 to spray jets 4 onto the outside surface 46 of reel shaft 6 once it rolls back onto the rear stops 33 in hook portions 30 of the arms. If desired, the reel shaft 6 can be rotated by a suitable device (not shown) as the adhesive is sprayed onto it. Conduits 7 run up to front pillar 13 and over base end 28 of lowering arms 11 to connect with nozzles 5. Slack is left in the conduits 7 to allow the free movement of lowering arms 11. After glue application, reel shaft 6 is lowered into the primary arms 23, which engage the reel shaft 6 with reel drum 2. As reel drum 2 advances web 44 through the nip 36, rotation of the reel shaft 6 brings the glue into contact with web 44. The web 44 sticks to the glue on the outer surface 46 of reel shaft 6 and begins winding onto reel shaft 6.

The third embodiment is advantageous in that the glue-spreading device 1 is remote from the moving parts near nip 36. Also, some time savings may be realized because reel shaft 6 can be sprayed while being retrieved from the stand 10.

FIG. 4 illustrates a fourth embodiment where the heated glue-spreading device 1 is suspended from the structure of the stand 10. Nozzles 5 are mounted on a support structure 49 that is pivotally connected to support beams 20 and 21, such that the support structure 49 can pivot about an axis extending in the cross-machine direction, between a stand-by position spaced relatively farther from the reel shaft 6 held in the lowering arms 11 in a lowered position as shown in phantom lines in FIG. 4, and an operative position relatively closer to the reel shaft 6 as shown in solid lines. Adhesive heating hopper 8 is fixed relative to the support beams 20, 21 and connected to nozzles 5 via conduits 7. Support structure 49 is moved between the stand-by and operative positions by a conventional actuator (not shown) such as an air cylinder to move the nozzles into and out of range of reel shaft 6 as it is lowered by lowering arms 11.

An empty reel shaft 6 is lifted by lowering arm 11 from stand 10 and is lowered in the direction of reel drum 2. As it is lowered, the nozzle support structure 49 is moved to the operative position to place nozzles 5 in proximity to empty reel shaft 6 and jets 4 dispense heated glue onto the outer surface of the empty reel shaft 6. Initiation of winding onto the reeling drum then proceeds similar to the process described above in the third embodiment.

FIG. 5 depicts a fifth embodiment where nozzles 5 are fixed to primary arms 23 and spray heated glue jets 4 onto the outer surface 46 of reel shaft 6 while it is gripped in the primary arms 23. Nozzles 5 are attached to a cross-machine support (not shown) that extends between the primary arms 23 and are located in close proximity to reel shaft 6. Conduits 7 are attached to the stand 10 and include flexible portions that extend from the stand 10 to the nozzles 5. This allows nozzles 5 to move along with primary arms 23 as they manipulate reel shaft 6.

FIG. 6 shows a sixth embodiment similar to that of FIG. 5, except the adhesive heating hopper 8 is fixed relative to the primary arms 23. In this embodiment, the hopper 8 can be designed to be exchangeable such that when one hopper 8 becomes empty, it is replaced by another full one, as opposed to being refilled with adhesive.

FIG. 7 depicts a seventh embodiment which includes a support structure 49 for nozzles 5 that is mounted atop the stand 10 to position nozzles 5 over the top of a newly retrieved empty reel shaft 6 while held in the lowering arms 11. The support structure 49 includes vertical posts 50 proximate to the pivot axis of lowering arms 11 and horizontal support arms 51 that are fixed to the posts 50 and extend toward the hook ends 30 of the arms 11. Nozzles 5 are fixed near to the ends of horizontal arms 51 and point generally downward toward the reel shaft 6 held in the hook portions 30 of arms 11. The reeling drum 6 can be either stationary or rotating while glue is being applied to it by nozzles 5.

FIG. 9 shows another embodiment of the heated glue-spreading device 1 similar to that of FIGS. 1 and 8, but having a single main conduit 52 that extends in the cross-machine direction, and a plurality of individual conduits 53 that branch off the main conduit 52 for supplying each of nozzles 5. Main conduit 52 is connected at one end to adhesive heating hopper 8 and its opposite end is closed. The conduits 53 are connected to main conduit 52 and extend downward to connect to nozzles 5. An advantage of this embodiment is that it cuts down on the amount of conduit that must be run to supply the nozzles 5.

FIG. 10 shows yet another embodiment of the heated glue-spreading device 1 employing a pair of translating nozzles 60 that move transverse to the machine direction. Each of the translating nozzles 60 is attached a rodless cylinder 62. The rodless cylinders 62 are parallel to each other and extend transverse to the machine direction. The cylinders 62 are positioned one above the other, and with sufficient clearance between them to ensure that the nozzles 60 do not collide during transverse movement. The cylinders 62 are fixed to the rack 9 which also provides support for a pair of cable tracks 63. The cable tracks 63 carry the pair of conduits 7 (one conduit in each track) that supply the pair of nozzles 60 with heated adhesive. The cable tracks 63 are flexible, segmented housings that protect and support the conduits 7 during motion of the translating nozzles 60.

The pair of translating nozzles 60 are placed in the middle with respect to the width of the paper web prior to adhesive application, and move outwards to the edges of the paper width, applying heated adhesive along their path of travel as shown in FIG. 11. Also, the nozzles 60 may be placed at the edges of the width of the paper web and moved toward the middle as shown in FIG. 12. When the nozzles apply adhesive to the paper web 44 the translating nozzles preferably should move as quickly as possible to minimize the spiral effect of the combined rotation and translation. Accordingly, the motions of the nozzles 60 preferably are motivated by rodless cylinders 62. However, other types of actuation devices could alternatively be used. The nozzles can apply adhesive to the web 44 and/or the reel shaft 6.

Although the present invention has been explained in connection with a particular type of machine, the invention is also applicable to other types of reel-ups and to other winding devices such as rewinders. The invention is applicable to various paper grades including board, print paper, tissue, etc. The invention is also applicable to various types of glue heating devices. Therefore, the description of a reel-up herein should not limit the applicability of the invention.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. An apparatus for winding a traveling web of fibrous tissue material onto a reel shaft to form a roll of the fibrous tissue material, comprising:

a supporting device for supporting the tissue web during winding;

a winding device for supporting the reel shaft and rotating the reel shaft about an axis thereof, at least one of the supporting and the winding devices being movable toward the other to place the rotating reel shaft in a winding position proximate the supporting device such that the tissue web on the supporting device is engaged by the rotating reel shaft;

at least one spray nozzle operable to spray an adhesive, the spray nozzle being located to spray the adhesive onto at least one of the tissue web and an outer surface of the reel shaft such that the tissue web is adhered to and begins to wind about the reel shaft as the reel shaft is brought into engagement with the tissue web on the supporting device; and an adhesive supply apparatus including a hopper for holding a quantity of adhesive and operable to heat the adhesive in the hopper to render the adhesive flowable, and to supply the adhesive under pressure to the spray nozzle.

2. The apparatus for winding a traveling web as claimed in claim 1, wherein the supporting device comprises a rotatable reel drum about which the tissue web is partially wrapped.

3. The apparatus for winding a traveling web as claimed in claim 2, further comprising a frame for rotatably supporting the reel drum, and wherein the spray nozzle is fixed relative to the frame.

4. The apparatus for winding a traveling web as claimed in claim 3, wherein the spray nozzle is located to spray the adhesive onto the tissue web upstream to the reel drum.

5. The apparatus for winding a traveling web as claimed in claim 3, wherein engagement of the reel drum and the reel shaft forms a nip therebetween, and the spray nozzle is located to spray adhesive into the nip.

6. The apparatus for winding a traveling web as claimed in claim 3, wherein the spray nozzle is located to spray the adhesive onto the outer surface of the reel shaft.

7. An apparatus for winding a traveling web of fibrous material onto a reel shaft to form a roll of the fibrous material, comprising:

a supporting device for supporting the web during winding;

a winding device for supporting the reel shaft and rotating the reel shaft about an axis thereof, at least one of the supporting and the winding devices being movable toward the other to place the rotating reel shaft in a winding position proximate the supporting device such that the web on the supporting device is engaged by the rotating reel shaft;

at least one spray nozzle operable to spray an adhesive, the spray nozzle being located to spray the adhesive onto at least one of the web and an outer surface of the reel shaft such that the web is adhered to and begins to wind about the reel shaft as the reel shaft is brought into engagement with the web on the supporting device;

an adhesive supply apparatus including a hopper for holding a quantity of adhesive and operable to heat the adhesive in the hopper to render the adhesive flowable, and to supply the adhesive under pressure to the spray nozzle; and a reel-changing device for receiving an empty reel shaft and transferring the empty reel shaft into the winding device, and wherein the nozzle is located to spray adhesive onto the reel shaft while held in the reel-changing device.

8. The apparatus for winding a traveling web as claimed in claim 7, wherein the reel-changing device comprises a pair of pivotal lowering arms, the nozzle being fixed relative to the lowering arms.

9. The apparatus for winding a traveling web as claimed in claim 7, wherein the lowering arms are pivotally mounted on a fixed structure that includes a stock for holding empty reel shafts for retrieval by the lowering arms, the nozzle being located to spray adhesive onto the reel shaft in the lowering arms prior to being lowered by the lowering arms toward the winding device.

10. The apparatus for winding a traveling web as claimed in claim 9, wherein die nozzle is fixed relative to the fixed structure.

11. The apparatus for winding a traveling web as claimed in claim 9, wherein the nozzle is fixed relative to the lowering arms.

12. The apparatus for winding a traveling web as claimed in claim 2, further comprising a frame for rotatably supporting the reel drum, and a nozzle support structure movably connected to the frame and supporting the spray nozzle, the support structure being movable so as to move the spray nozzle towards the reel shaft for spraying the adhesive onto the outer surface of the reel shaft and away from the reel shaft after spraying the adhesive thereon.

13. An apparatus for winding a travel web of fibrous material onto a reel shaft to form a roll of the fibrous material, comprising:

a supporting device for supporting the web during winding;

a winding device for supporting the reel shaft and rotating the reel shaft about an axis thereof, at least one of the supporting and the winding devices being movable toward the other to place the rotating reel shaft in a winding position proximate the supporting device such that the web on the supporting device is engaged by the rotating reel shaft;

at least one spray nozzle operable to spray an adhesive, the spray nozzle being located to spray the adhesive onto at least one of the web and an outer surface of the reel shaft such that the web is adhered to and begins to wind about the reel shaft as the reel shaft is brought into engagement with the web on the supporting device;

an adhesive supply apparatus including a hopper for holding a quantity of adhesive and operable to heat the adhesive in the hopper to render the adhesive flowable, and to supply the adhesive under pressure to the spray nozzle;

wherein the supporting device comprises a rotatable reel drum about which the web is partially wrapped;

a frame for rotatably supporting the reel drum, and a nozzle support structure movably connected to the frame and supporting the spray nozzle, the support structure being movable so as to move the spray nozzle towards the reel shaft for spraying the adhesive onto the outer surface of the reel shaft and away from the reel shaft after spraying the adhesive thereon; and a lowering device for lowering the reel shaft from a stock toward the winding device, and wherein the support structure is operable to move the nozzle to positions proximate the reel shaft while held in the lowering device.

14. The apparatus for winding a traveling web as claimed in claim 1, wherein the spray nozzle is mounted on the winding device.

15. The apparatus for winding a traveling web as claimed in claim 14, wherein the adhesive supply apparatus is mounted on the winding device.

16. The apparatus for winding a traveling web as claimed in claim 14, wherein the spray nozzle is positioned to spray adhesive onto the outer surface of the reel shaft.

17. The apparatus for winding a traveling web as claimed in claim 14, wherein the supporting device comprises a reel drum and the adhesive is sprayed into a nip formed between the reel drum and the reel shaft.

18. The apparatus for winding a traveling web as claimed in claim 1, wherein said spray nozzle is transversely moveable for applying adhesive along at least one of the reel shaft and the traveling web.

19. A method for winding a traveling web of fibrous tissue material in a papermaking machine comprising the steps of:

heating an adhesive to a predetermined temperature in a tank with a heater to render the adhesive flowable;

guiding the tissue web from the papermaking machine toward a rotating reel shaft;

dispensing the flowable adhesive to at least one applicator nozzle;

applying the adhesive from the applicator nozzle onto at least one of the tissue web and the reel shaft; and initiating contact between the tissue web and the reel shaft such that the tissue web adheres to the reel shaft and is wound thereabout.

20. The method as claimed in claim 19, wherein said applying step comprises spraying the adhesive from the applicator nozzle.

21. The method as claimed in claim 20, wherein said spraying step comprises spraying the tissue web upstream of the reel shaft.

22. The method as claimed in claim 20, wherein said spraying step comprises spraying the adhesive into a nip formed between the reel shaft and a supporting device on which the tissue web is supported.

23. The method as claimed in claim 20, wherein said spraying step comprises spraying the adhesive onto the reel shaft.

24. A method for winding a traveling web of fibrous material in a papermaking machine comprising the steps of:

heating an adhesive to a predetermined temperature in a tank with a heater to render the adhesive flowable;

guiding the web from the papermaking machine toward a rotating reel shaft;

dispensing the flowable adhesive to at least one applicator nozzle;

applying the adhesive from the applicator nozzle onto at least one of the web and the reel shaft;

initiating contact between the web and the reel shaft such that the web adheres to the reel shaft and is wound thereabout;

spraying the adhesive from the applicator nozzle; and using reel-changing device to retrieve an empty reel shaft from a stock of empty reel shafts, the reel-changing device then lowering the retrieved reel shaft from the stock and transferring the reel shaft into a winding device operable to rotate the reel shaft to wind the web thereon, and wherein the adhesive is sprayed onto the reel shaft after being retrieved by the reel-changing device.

25. The method as claimed in claim 24, wherein the step of initiating contact includes using the winding device to move the reel shaft against a supporting device on which the web is supported.

26. The method as claimed in claim 24, wherein said spraying step further includes spraying the reel shaft while held in the reel-changing device.

27. The method as claimed in claim 26, further comprising rotating the reel shaft as adhesive is being sprayed thereon.

28. The method as claimed in claim 24, wherein the adhesive is sprayed on the reel shaft after being lowered from the stock while held in the reel-changing device.

29. The method as claimed in claim 24, wherein said spraying step comprises spraying the reel shaft after being transferred into the winding device.

30. The method as claimed in claim 20, wherein the nozzle is traversed in a cross-machine direction as adhesive is being dispensed onto at least one of the tissue web and the reel shaft.

31. An apparatus for winding a traveling web of fibrous material onto a reel shaft to form a roll of the fibrous material, comprising:

a supporting device for supporting the web during winding;

a winding device for supporting the reel shaft and rotating the reel shaft about an axis thereof, at least one of the supporting and the winding devices being movable toward the other to place the rotating reel shaft in a winding position proximate the supporting device such that the web on the supporting device is engaged by the rotating reel shaft;

at least one spray nozzle operable to spray a gel adhesive, the spray nozzle being located to spray the gel adhesive onto at least one of the web and an outer surface of the reel shaft such that the web is adhered to and begins to wind about the reel shaft as the reel shaft is brought into engagement with the web on the supporting device; and an adhesive supply apparatus including a hopper for holding a quantity of gel adhesive and operable to heat the gel adhesive in the hopper to render the gel adhesive flowable, and to supply the gel adhesive under pressure to the spray nozzle.

32. A method for winding a traveling web of fibrous material comprising the steps of:

heating a gel adhesive to a predetermined temperature in a tank with a heater to render the adhesive more flowable;

guiding the web toward a rotating reel shaft;

dispensing the heated gel adhesive to at least one applicator nozzle;

applying the gel adhesive from the applicator nozzle onto at least one of the web and the reel shaft; and initiating contact between the web and the reel shaft such that the gel adhesive adheres the web to the reel shaft aid the web is wound thereabout.

* * * * *

UNITED STATES PATENT AND TRADEMARK OFFICE

CERTIFICATE OF CORRECTION

PATENT NO. : 6,805,317 B1
DATED : October 19, 2004
INVENTOR(S) : Andersson et al.

It is certified that error appears in the above-identified patent and that said Letters Patent is hereby corrected as shown below:

Title page,
Item [73], Assignee, "Valmet-Karlstad AB" should read -- Metso Paper Karlstad AB --;
Item [57], ABSTRACT,
Line 10, cancel "Preinknoll".

Column 10,
Line 14, after "shaft" insert -- having opposed ends --;
Line 18, after "shaft" insert -- at the ends of the reel shaft --.

Column 12,
Line 10, after "nozzle to" insert -- at least one -- and "positions" should read -- position --.

Column 14,
Line 10, after "spray a" insert -- water-soluble --;
Line 23, after "heating a" insert -- water-soluble --.

Signed and Sealed this

Fourteenth Day of June, 2005

JON W. DUDAS
*Director of the United States Patent and Trademark Office*